United States Patent [19]

McQuirk

[11] Patent Number: 4,858,395

[45] Date of Patent: Aug. 22, 1989

[54] FIRE PROTECTION FOR STRUCTURES

[76] Inventor: Kyle McQuirk, 313 High St., San Luis Obispo, Calif. 93401

[21] Appl. No.: 229,143

[22] Filed: Aug. 5, 1988

[51] Int. Cl.[4] ..... E04B 1/34

[52] U.S. Cl. ..... 52/3; 135/903; 160/120; 52/63; 52/83

[58] Field of Search ..... 52/3, 4, 63, 83; 135/903; 160/120, 122, 242

[56] References Cited

U.S. PATENT DOCUMENTS

| | | | |
|---|---|---|---|
| 715,185 | 12/1902 | Warner | 160/120 |
| 1,009,783 | 11/1911 | Padley | 135/903 |
| 2,365,127 | 12/1944 | Wagner | 160/120 |
| 3,715,843 | 2/1973 | Ballinger | 52/3 |

*Primary Examiner*—James L. Ridgill, Jr.
*Attorney, Agent, or Firm*—Jerry N. Lulejian

[57] ABSTRACT

A fire protection device for a structure using a fire resistant sheet material compacted in a folded condition in a housing on the roof of the structure so that when deployed from the housing it can be unfolded to quickly envelop the structure.

5 Claims, 2 Drawing Sheets

FIRE PROTECTION FOR STRUCTURES

BACKGROUND OF THE INVENTION

The present invention is a fire protection device which involves placing a fire resistant sheet material over a building to prevent the building from burning down in a surrounding fire. The present invention does not relate so much to the type of sheet material used or the fact that a building is being covered with a fire resistant sheet material, but relates more specifically to how to compact and deploy the sheet material efficiently and quickly before the building catches on fire.

There is nothing more important with these types of fire protection devices than being able to quickly deploy them before a fire starts on the building to be protected. Often there is little warning of an approaching fire, especially in urban areas where the threatening fire starts in the next door neighbor's house at night. Also, will fires overtake rural buildings with amazing speed. Without the ability to quickly and completely deploy the fire protective sheet material, the building will succumb to fire before the sheet material can be deployed.

The prior art devices have been unusually complicated in the mechanisms they have chosen or they offer no mechanism at all. In addition, the mechanisms require too much time to deploy, and due to the mechanisms complexity, the deployment is unreliable. Since complete deployment and encompassing of the building is necessary to enable the sheet material to prevent the building from succumbing to the surrounding fire, the slightest mechanical failure will cause the building to burn. The prior devices which offer no mechanism for deployment require entirely too much time to deploy and sometimes are impossible to deploy due to the high velocity winds which are created by an oncoming fire.

References known which relate to prior art fire protection devices similar to the present invention are as follows:

U.S. Pat. No. 3,877,525 to Husson et al.
U.S. Pat. No. 3,969,216 to Isobe.
U.S. Pat. No. 3,715,843 to Ballinger.
U.S. Pat. No. 905,002 to Rosenberg.

The present invention has solved the problems of the prior art devices by creating a simple and reliable deployment mechanism and by reducing the time for complete deployment by folding the sheet material before it is compacted so that one sheet material will cover two or more adjacent walls of the building.

SUMMARY OF THE INVENTION

The present invention relates to a fire protection device for a structure having adjacent supporting walls at angles to each other and a roof. The present invention preferably comprises (1) at least one fire resistant sheet material, each of sufficient area to substantially cover at least a portion of the roof and two adjacent supporting walls of the building structure, each sheet material being folded over itself at least once and defining at least one folded portion and an unfolded portion so that each folded portion will substantially cover one adjacent wall and the unfolded over portion will cover another adjacent wall; (2) a means for deployably compacting each sheet material; and (3) a means for deploying each sheet material over its at least two adjacent walls.

The invention may also comprise (1) a means for securing each deployed sheet material over its at least two adjacent walls, (2) a means for interconnecting at least two sheet materials to substantially encompass the building with the sheet materials and (3) a fire resistant housing for covering and protecting each cylinder with its rolled up sheet material.

DETAILED DESCRIPTION OF THE INVENTION

The present invention is a fire protection device which involves placing a fire resistant sheet material over a building to prevent the building from burning down in a surrounding fire. The present invention does not relate so much to the type of sheet material used or the fact that a building is being covered with a fire resistant sheet material, but relates more specifically to how to compact and deploy the sheet material efficiently and quickly before the building catches on fire.

There is nothing more important with these types of fire protection devices than being able to quickly deploy them before a fire starts on the building to be protected. Often there is little warning of an approaching fire, especially in urban areas where the threatening fire starts in the next door neighbor's house at night. Also, wild fires overtake rural buildings with amazing speed. Without the ability to quickly and completely deploy the fire protective sheet material, the building will succumb to tire before the sheet material can be deployed.

The prior art devices have been unusually complicated in the mechanisms they have chosen or they offer no mechanism at all. In addition, the mechanisms require too much time to deploy, and due to the mechanism's complexity, the deployment is unreliable. Since complete deployment and encompassing of the building is necessary to enable the sheet material to prevent the building from succumbing to the surrounding fire, the slightest mechanical failure will cause the building to burn. The prior art devices which offer no mechanism for deployment require entirely too much time to deploy and sometimes are impossible to deploy due to the high velocity winds which are created by an oncoming fire.

The present invention has solved the problems of the prior art devices by creating a simple and reliable deployment mechanism and by reducing the time for complete deployment by folding the sheet material before it is compacted so that one sheet material will cover two or more adjacent walls of the building.

Figure 1:
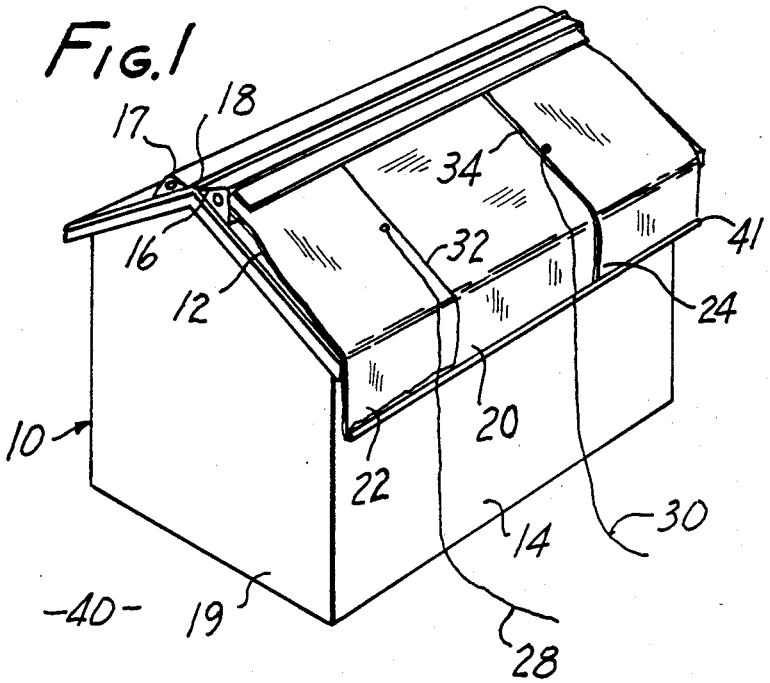
FIG. 1 is a perspective view of the present invention installed on a house.

Referring specifically to FIG. 1, a building 10 is shown which has a pitched roof 12 and perpendicular walls 14 and 19. The present invention in its preferred embodiment comprises housings 16 and 17 adjacent and parallel to the ridge 18 of the roof 12, with each housing 16 and 17 containing a cylinder 26 (shown in FIG. 4) upon which the sheet material 20 is rolled in order to compact the sheet material 20 within each housing 16 and 17. The sheet material 20 is folded in at least one location to define folded portions 22 and 24 before the sheet material 20 is rolled over the cylinder 26 within each housing 16 and 17.

Deployment or the compacted sheet material 20 is accomplished by lines 28 and 30 which are connected to the edges 32 and 34 of the folded portions 22 and 24, respectively. The user pulls on lines 28 and 30 to cause the sheet material 20 to be removed from housing 16, deployed over the roof 12 in its folded over condition and pulled to the ground 40 where it will later be secured.

Figure 2:
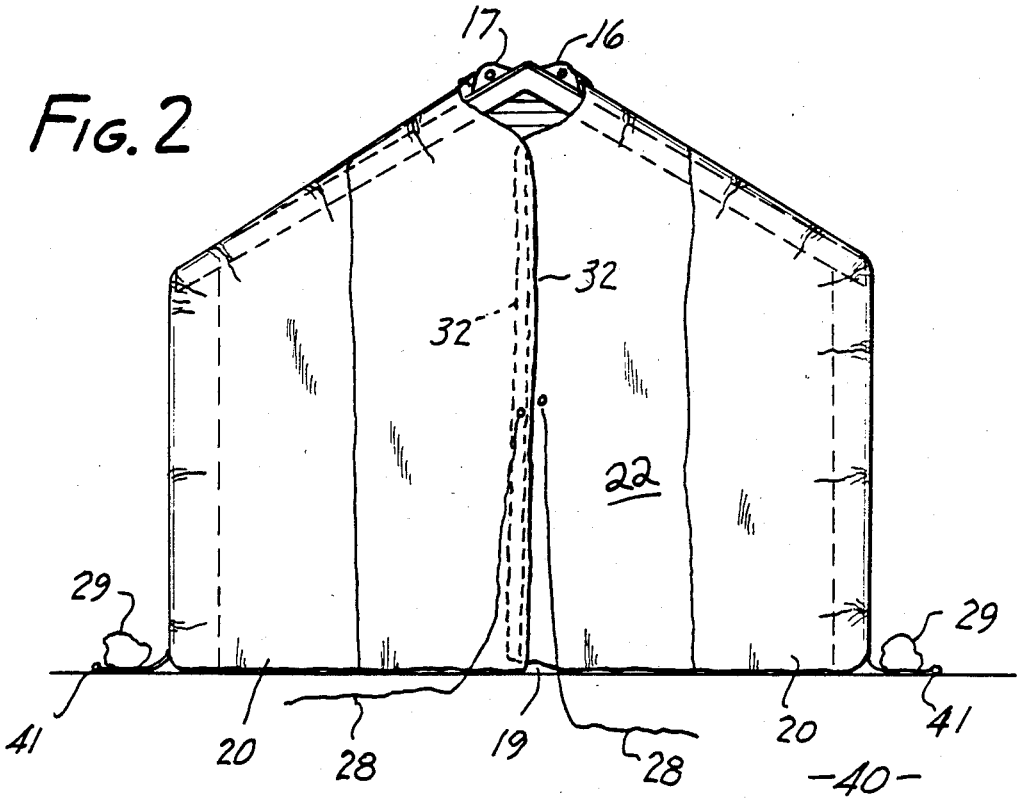
FIG. 2 is a side elevational view of the present invention installed on a house.

Referring specifically to FIG. 2, each sheet material 20 is deployed over the wall 19 (as well as wall 14 of FIG. 1) by pulling on lines 28 and fastening edges 32 where they intersect with Velcro (not shown) or other suitable means of securing these edges together against the wind caused by a fire. The same procedure is accomplished for the other wall (not shown) by pulling lines 30 and securing the edges 34 together with Velcro. The result is a very quickly and completely deployed fire resistant sheet material 20 which will substantially prevent the building 10 from burning.

The sheet materials 20 may be secured to the ground 40 by placing rocks 29 over the material which overlays the ground 40. In addition, a bar 41 may be sewn in the leading edge of each sheet material 20 to better secure each sheet material to the ground 40 and to better deploy the sheet material 20 from its housing (16 or 17).

Figure 3:
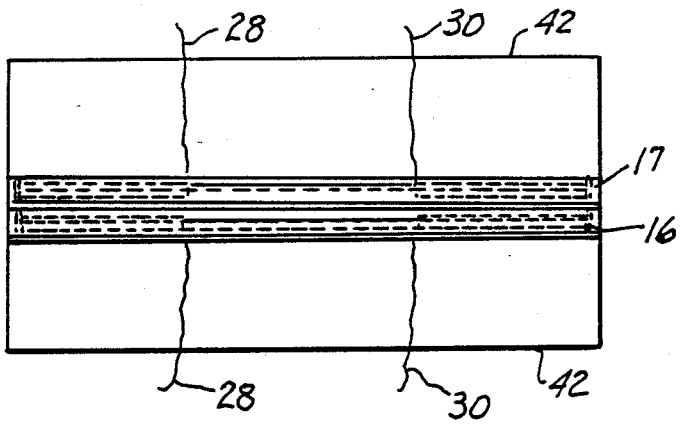
FIG. 3 is a top view of the house with the present invention in thereon.

Referring to FIG. 3, the housings 16 and 17 can be seen with their compacted sheet materials 20 (not shown) and lines 28 and 30 running over the eave 42 of the building 10 so that they can be reached by the user and quickly deployed.

It must be understood that the above disclosure of the preferred embodiment is shown with a rather simple building in order to show the concept of how the present invention is practiced. Each building will require a different way of placing the housings 16 and 17, may require more housings 16 and 17 and the placement on the roof may need to be different. In addition, it is not required that the roof of the building protected by the present invention be pitched. The present invention with the appropriate changes should be adaptable to any building or structure which has a roof and adjacent walls at angles to each other.

Figure 4:
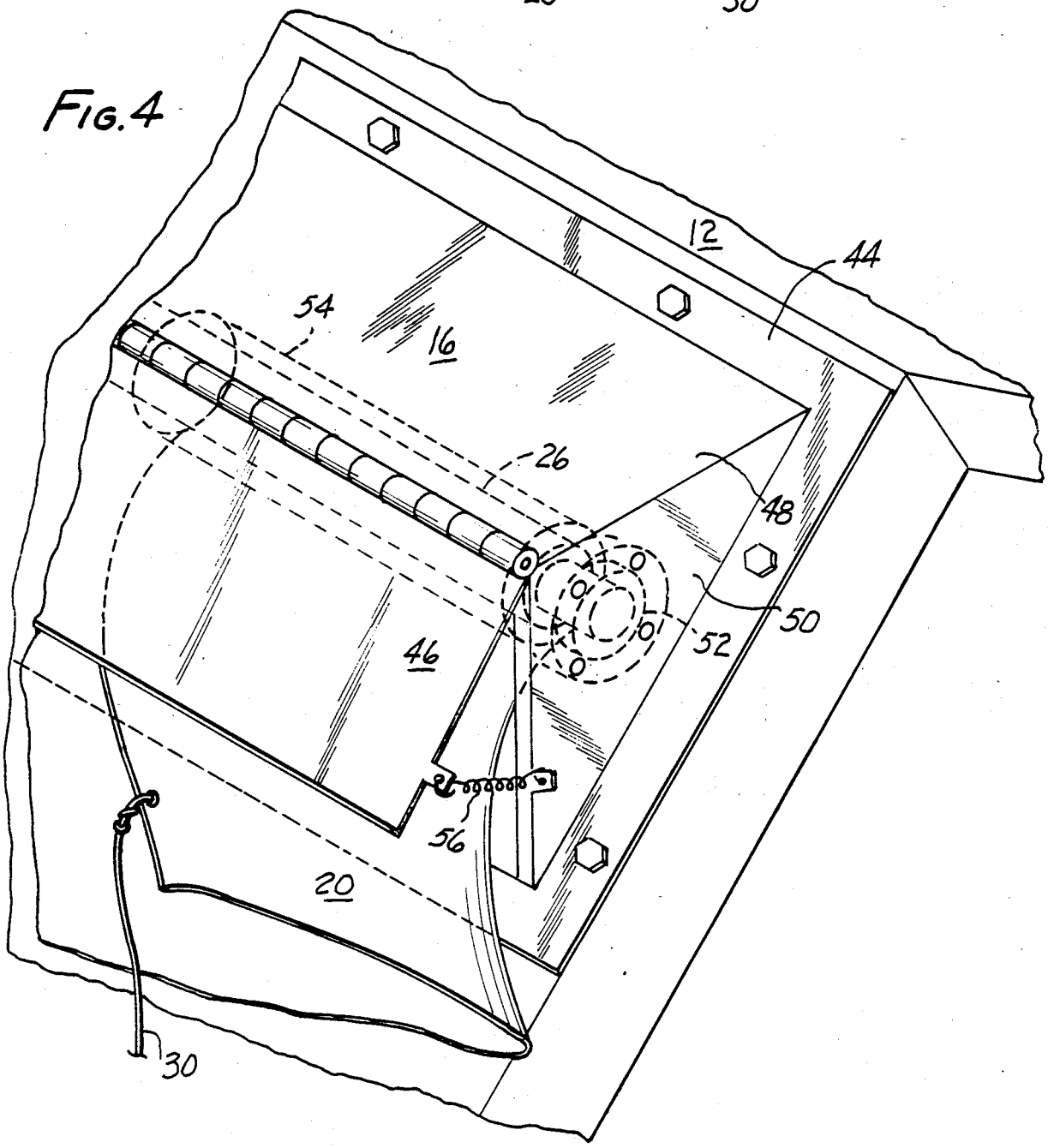
FIG. 4 is a perspective view of the housing of the present invention installed on the house.

Referring specifically to FIG. 4, the preferred housing 16 (as well as the housing 17) is triangular in shape when closed and comprised of a bottom plate 44 boiled to the roof 12, two hinged sheets 46 and 48, two triangular side plates 50 (only one of which is shown), bearing assembly 52 and support cylinder 54. The bearing assembly 52 is attached to side plates 50 to suspend and rotate the cylinder which may also be supported by additional roller assemblies (not shown) along the length of cylinder 54 if needed depending on the length of the cylinder 54 required to span the ridge 18 of the roof 12. The type and size of the bearing assembly 52 will have to be chosen depending on the amount of load each will have to carry and whether there are other roller assemblies supporting the cylinder 54 along its length.

Hinged sheet 46 preferably hinges open when line 30 is pulled to allow sheet material 20 to exit the housing 16 and to protect the sheet material 20 when not in use by shutting bra spring 56. The hinged sheets 46 and 48, the side panels 50 and the bottom plate 44 are preferably composed of anodized aluminum to reduce the total load that the present invention offers to the roof 12. Cylinder 54 may simply be an appropriate length of steel pipe of a size that will adequately sustain the load of the sheet material 20 fully rolled.

Once the sheet material 20 has been deployed manually by pulling the appropriate lines, the user may recompact the sheet material 20 by pulling up on hinged sheet 46 and manually rotating cylinder 54 until the sheet material 20 is completely contained within housing 16. This procedure can be repeated for each additional housing used to protect the building involved.

The sheet material 20 may be of any of the available fire resistant cloths such as those composed of fiberglass cloth laminated to aluminum foil. The preferred cloth should be one which is composed of a fiberglass cloth conforming to form 4, class C, ECG-1674 or ECDE-1675 of military specifications MIL-Y-1140, 0.0015 inch thick aluminum foil (dead soft (0) temper) laminated with an adhesive consisting of two components: Whittaker Corporation type 49002 polyester resin in solution together with Dow Chemical Company type PAPI 135 curing agent. The polyester resin should be the polyethylene terephthalate type. The cured adhesive shall be an isocyanate cross-linked polyester. The Whittaker Corporation type 49002 resin should be either style 46970 in a methylene chloride solvent system or style 46971 in a 1,1,2 trichloroethane solvent system. Toluene and III trichloroethane may be added to facilitate processing, providing no residual amounts of those solvents remain in the cured adhesive.

The sheet material 20 for each housing (16 and 17) should be cut to dimensions which when unfolded will reach the ground 40 with preferably three (3') feet to four (4') feet to spare and reach slightly more than half way around each adjacent wall (19). The sheet material 20 should be folded so that it can be rolled within housing 16 or 17.

The preceding disclosure of the preferred embodiment of the present invention shall not be considered to define the scope of the present invention. Instead, the scope of the present invention shall be determined by reference to the following claims and their equivalents.

I claim:

1. In a structure having adjacent supporting walls at angles to each other and a roof, a fire protection device comprising:

at least two fire resistant sheet materials, each tailored to fit a specific portion of the roof and specific portions of at least two adjacent supporting walls of the building structure;

each sheet material being folded to define at least one folded portion and an unfolded portion with each folded portion having dimensions adapted to fit the specific portion of one of the at least two adjacent supporting walls for its sheet material, and the unfolded portion having dimensions adapted to fit the specific portion of the roof and another supporting wall for its sheet material;

a means for deployably compacting each folded sheet material;

a means for deploying each folded sheet material to fit over its specific portions of the roof and at least two adjacent walls; and a means for interconnecting the sheet materials to substantially encompass the building with the sheet materials.

2. The fire protection device in accordance with claim 1 further comprising a means for securing each deployed sheet material over its at least two adjacent walls.

3. The fire protection device in accordance with claim 1 in which the means for deploying each folded sheet material comprises lines attached to the folded and unfolded portions of each sheet material.

4. The fire protection device in accordance with claim 1 in which the roof is pitched, has a ridge and the means for compacting each sheet material comprises a rotatable cylinder for each sheet material, each rotatable cylinder located adjacent to the ridge, and capable of rolling up its sheet material.

5. The fire protection device in accordance with claim 4 further comprising a fire resistant housing for covering and protecting each cylinder with its rolled up sheet material.

* * * * *